United States Patent [19]

Gonzalez-Hernandez

[11] 3,980,370

[45] Sept. 14, 1976

[54] SAFETY PLUG-IN JACK BASE

[76] Inventor: Angel Gonzalez-Hernandez, Somontin, 116, Madrid, 33, Spain

[22] Filed: June 25, 1975

[21] Appl. No.: 590,173

[30] Foreign Application Priority Data

July 2, 1974 Spain ..... 204316

[52] U.S. Cl. ..... 339/40; 200/51.09

[51] Int. Cl.[2] ..... H01R 13/44

[58] Field of Search ..... 339/40–42, 339/111; 200/50 B, 51 R, 51.09

[56] References Cited

UNITED STATES PATENTS 2,224,366 12/1940 Johnston ..... 200/51.09 X

FOREIGN PATENTS OR APPLICATIONS 374,145 8/1939 Italy ..... 200/51.09

66,626 8/1943 Norway ..... 200/50 B 177,713 4/1922 United Kingdom ..... 339/40

*Primary Examiner*—Joseph H. McGlynn

*Assistant Examiner*—Craig R. Feinberg

*Attorney, Agent, or Firm*—Ladas, Parry, Von Gehr, Goldsmith & Deschamps

[57] ABSTRACT

An electrical outlet for receiving a pronged plug-in jack. The outlet has prong receiving sockets, one of which is live. A breaker switch is embodied in the outlet and located between the power supply and the live socket. The breaker switch, which is normally open and is closed only when the jack is plugged in to the socket, is actuated by the prongs of the jack. The outlet further comprises a lock which prevents unintentional closing of the breaker switch and which is released by the jack upon entering the socket.

5 Claims, 10 Drawing Figures

SAFETY PLUG-IN JACK BASE

The invention refers to a safety plug-in jack base whose novelty resides in the fact that its terminals or orifices, receivers of the pins of the plug, do not receive a current feed until said plug-in jack has been inserted.

Among the multiple safety devices which, from day to day, appear on the market to protect the users from shocks in electric installations, the plug-in jack bases have evidently been overlooked heretofore. Such bases precisely constitute the connecting points for the selective use of the current, and since same should forcedly be given the possibility of being discharged, they can, perhaps more easily than any other electric device, become the origin of an electric shock.

Experts in the art are aware of the fact that the immense majority of plug-in jack bases, which are used at present both for industrial and domestic purposes, lack all types of protection and their terminals or orifices, receivers of the connecting pins, are practically positioned so as to be reached directly by any object and even, in some limited cases, by hand. This poses serious safety problems, especially at a domestic level insofar as children are concerned, since, due to their curiosity and natural restlessness, they frequently handle the plug-in jack bases, suffering accidents which are sometimes very serious.

Some inventions have certainly been made to modify the plug-in jack bases in order to avoid their facilitating a current outlet, when they are not in use. However, this is an objective which has heretofore been accomplished in an incomplete manner and only on the basis of very complex arrangements, which are expensive to manufacture.

In effect, with regards to the incompleteness of the known solutions, the terminals of the majority of the few plug-in jack bases, protected with safety devices which are presently known, are not electrically disconnected during the time in which they are not in use, but they are only located in such a way that access thereto is difficult. Thus, although it is more difficult for an accidental shock to be produced, it is not avoided completely.

With regards to the completeness of such solutions, on the other hand, it is evident that the use of too many movable parts in the plug-in jack bases and, therefore, the use of too many mechanical complements, are required, thus making their manufacture and assembly expensive.

The plug-in jack base, object of the present invention, overcomes both drawbacks. It will be seen that its use is absolutely safe, since electric current cannot be discharged when same is not in use, and its construction is so simple that its price is hardly increased with respect to the unprotected plug-in jack base whose commercial form or shape itself can even be adopted.

In essence, the plug-in jack base of the invention is noteworthy since it has, in its interior, means for cutting the supply circuit to the terminals, said cutting means being controlled by an outer button which can be depressed only by means of the insertion of the plug-in jack which, in each case, is used in combination with said base.

It will subsequently be seen that the basic structural arrangement implied hereby is susceptible to diverse modes of embodiment in order to adapt same to different needs. Furthermore, different specific solutions can even be adopted to solve the various problems posed by the device, with the object of maintaining its component elements in an operative position.

However, all this can be effected without departing from the nature of the invention, which is as claimed in the attached note.

For example, with regards to the suitability of the plug-in jack base according to its use or nature, the current cutting means can be applied to feed wires of a single terminal, if said base is prepared to operate with a single current phase, or it can be applied to feed wires of two or more terminals, if the base, correspondingly, is designed to function with two or more current phases.

With regards to the specific solutions used to solve the different problems posed by the permanent operative positioning of the parts of the device, it is evident that its variation constitutes a secondary aspect of the matter and that, in each case, those which are more convenient, according to the form or nature of the plug-in jack base, could be used.

In view of the aforegoing, and although a set of drawings, which represents a specific material mode of embodiment of the invention, is attached to the present specification, it should be understood that such mode of embodiment merely constitutes a non-limitative example, its only purpose is to facilitate the understanding of the idea to be presented as novel.

Concretely, the different views and schemes of the drawings illustrate a plug-in jack base to be fixed in a wall, designed to function only with one phase and without neutral. Therefore, and as will subsequently be seen, it only has current cutting means to one of its terminals or orifices, receivers of the pins of the plug-in jack. In another case, as has already been stated, such cutting means could be double or triple, based on the same basic structural arrangement.

The different figures represented in the drawings correspond to the following:

Figure 2:
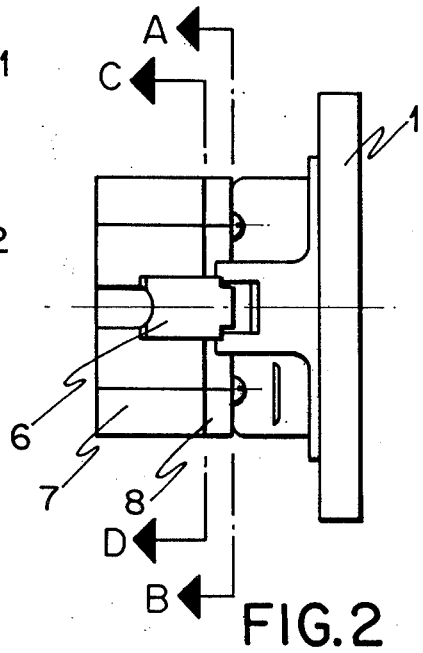
FIG. 2 represents an upper side view of the same base.
Figure 3:
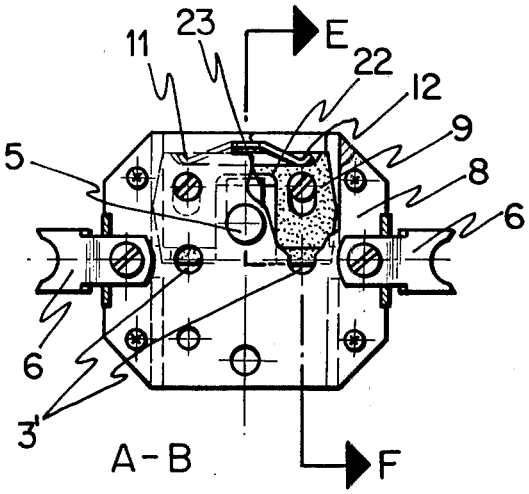

FIG. 3 corresponds to a cross-section of the plug-in jack base according to plane A–B indicated in FIG. 2, illustrating the plug-in jack base in question without the ornamental protecting plate.

Figure 4:
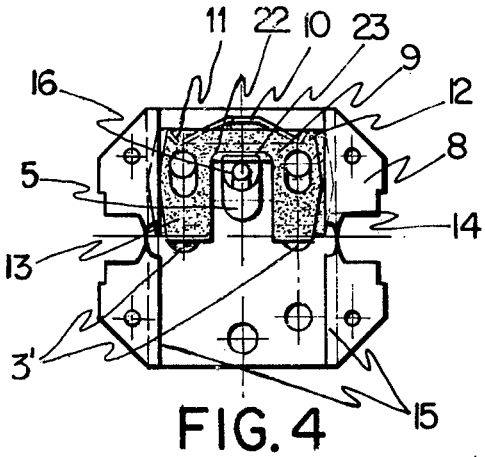

FIG. 4 represents a plan view along the posterior part of the piece illustrated in FIG. 3, which closes, from the top, the plug-in jack base.

Figure 5:
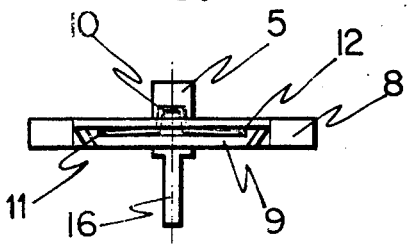

FIG. 5 corresponds to an upper plan view of the same piece.

Figure 6:
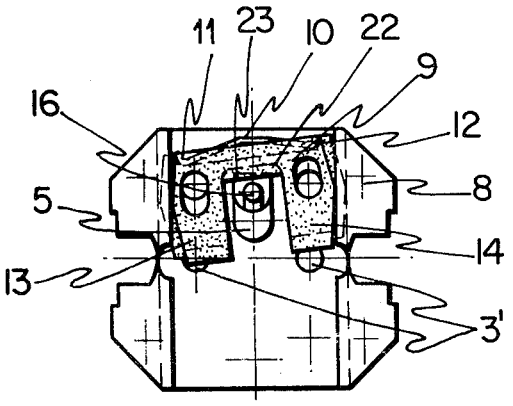

FIG. 6 corresponds to a view similar to that of FIG. 4 but specific parts are in different functional positions.

Figure 7:
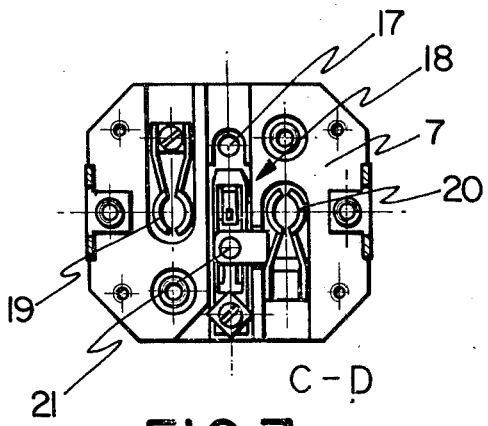

FIG. 7 represents a section of the plug-in jack base, taken along line C–D indicated in FIG. 2, to illustrate the mentioned base without the ornamental plate and without the piece which closes it, at its upper part, represented separately, as already mentioned, in FIGS. 4, 5 and 6.

Figure 8:
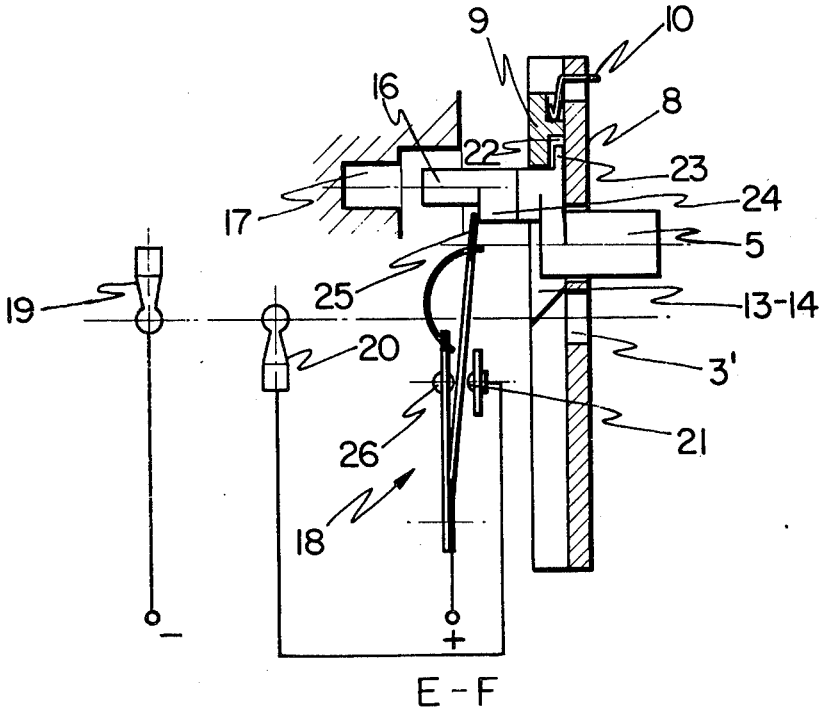
Figure 9:
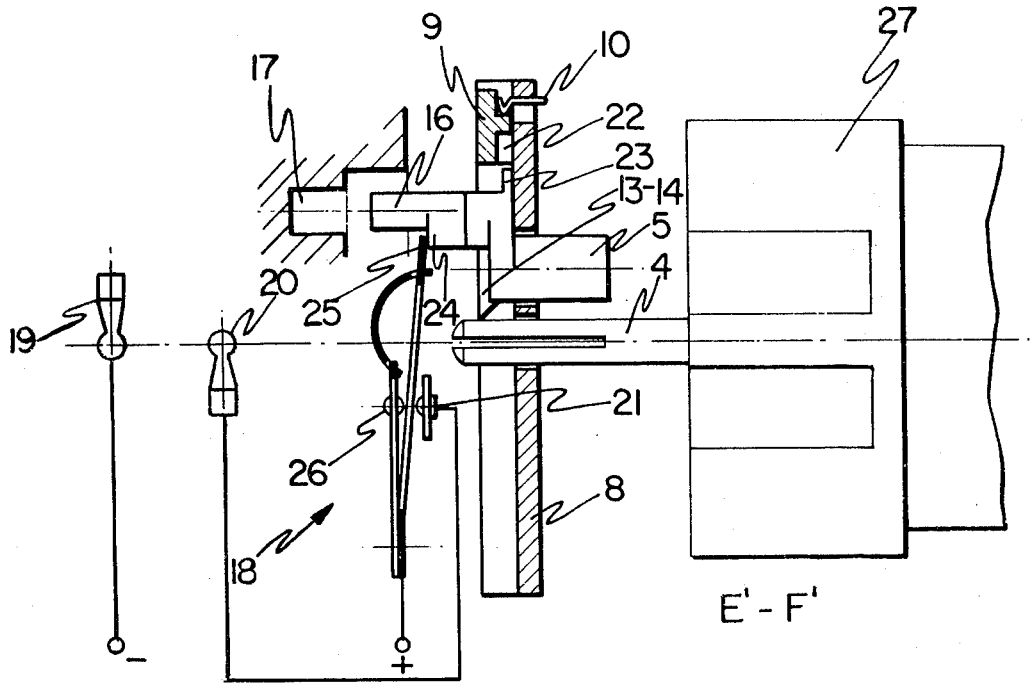
Figure 10:
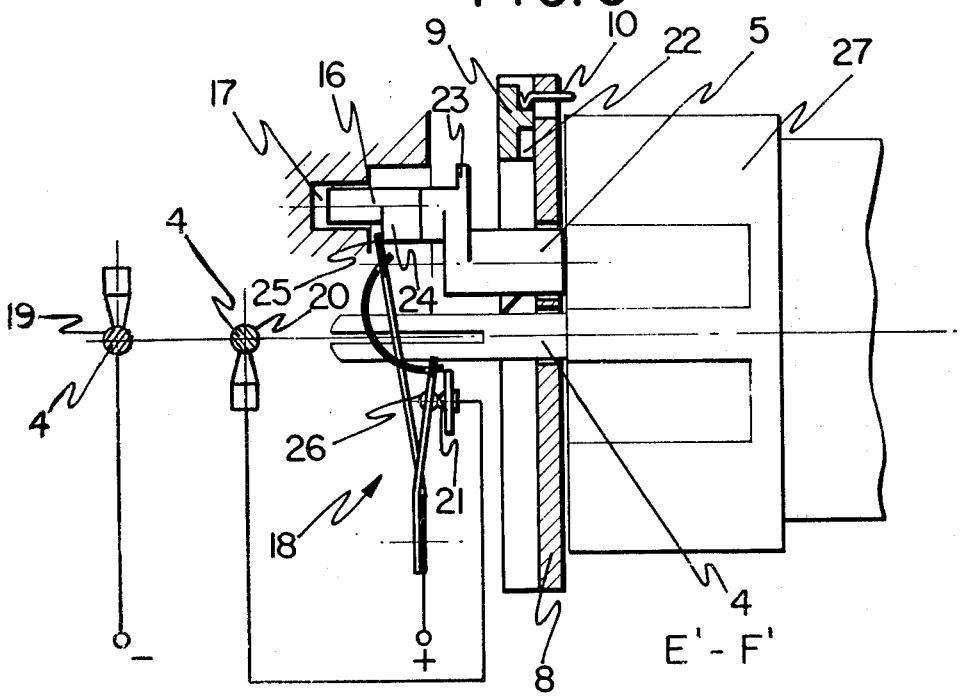

FIGS. 8, 9 and 10 correspond to other functional schemes of the safety device incorporated to the plug-in jack base of the invention.

Figure 1:
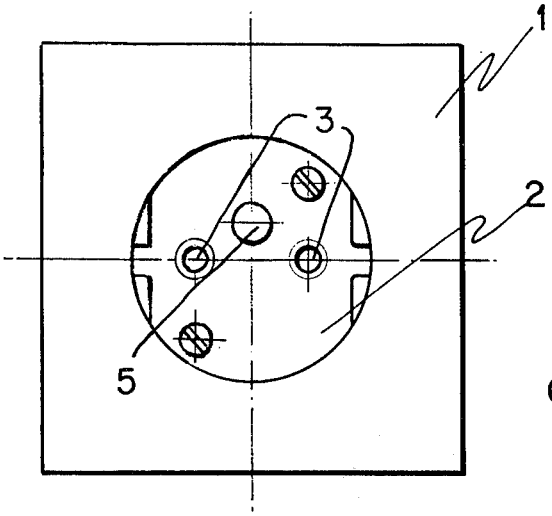
FIG. 1 represents a plan view of a plug-in jack base made according to the invention.

Referring now to the drawings and more specifically to FIGS. 1 and 2, it can be seen that the plug-in jack base, as is customary, comprises a body to be fixed in a wall, in this case formed by the overlapping of the pieces 7 and 8, and by an ornamental plate 1, which is provided with a cavity 2, receiver of the plug-in jack, the bottom of which has orifices 3 for the pins of the plug-in jack. It can then be seen that the external shape of the base can be that of the commercial shapes in use and that its mode of assembly to the cavity made in the wall to receive it is also the same, to which wall it is fixed by means of a pair of clamps 6 which is open to block same by tightening of screws. However, none of these features form part of the invention. Reference is made thereto and they are represented in the drawings only to illustrate that the inclusion of the characteristics which are to be claimed, do not imply the need of departing from the commercial forms in use.

What already forms part of the invention is the fact that the bottom of the cavity 2, made in the ornamental plate 1 to receive the plug-in jack, is provided with a passage for a button 5 which is blocked from manual operation but which can be depressed through the insertion of the plug-in jack itself, to establish operation of at least one breaker housed within the base and sandwiched between the feed wire of at least one of the lead-out terminals of the mentioned base.

In the mode of embodiment represented, the plug-in jack base, considered in itself, is constituted by means of the overlapping of pieces 7 and 8 which are illustrated in FIG. 2, and the button 5 is guided along the piece 8, applied to the operation of a single breaker, which is placed between the current supply wire of the positive pole.

Piece 8, besides its transversal passage for the button 5, has, at its posterior surface, as can more clearly be seen in FIGS. 4 and 6, a longitudinal recess 15, whose section is preferably dovetailed, along which piece 9, which is flexibly urged towards the button, can slide with an orientation perpendicular to the button, with respect to which butt means are incorporated and which has two prolongations 13 and 14 partially placed between the orifices 3' with which piece 8 is provided and corresponding to orifices 3 provided in the ornamental plate 1 for the introduction of the pins of the plug-in jack.

In the preferred mode of embodiment, the flexible positioning means of the piece 9 is constituted by a spring in the form of a yoke 10, which is supported at its central path on the piece 8 and whose two arms 11 and 12 press piece 9 onto two points, substantially symmetrical with respect to the longitudinal axis, with approximately the same stress.

In the preferred mode of embodiment, likewise, the butt means provided in piece 9 with respect to the button 5, is constituted by an incoming recess 22 made on piece 9, wherein a projection 23 of the button can be housed (both characteristics can more clearly be seen in the schemes illustrated in FIGS. 8, 9 and 10, from which it is evident that the action of the butt means consists in avoiding the depression of the button 5).

It can clearly be understood, however, that both the flexible positioning means of piece 9 and the butt means could adopt another mode of embodiment (the flexible means could be constituted by another type of spring which will press piece 9 only on one point, situated on its longitudinal axis, and the butt means could, for example, be inverse to that represented), without altering the basic arrangement.

Irrespective of the case, the flexible positioning means should permit, together with the fact that piece 9 is susceptible of pitching slightly within its guide means, said piece 9 to effect a fraction of a turn, as represented in FIG. 6 where one of the orifices 3' of piece 8 has been left uncovered, the projection 23 of button 5 cannot project from within the housing or recess 22 made in said piece 9 for such projection 23.

Raising of piece 9 contrary to its positioning means 10 is achieved by means of the pins themselves of the plug-in jack, since the ends of its prolongations 13 and 14, which partially intervene in the orifices 3' for said pins, have the shape of wedges (refer again to FIGS. 8, 9 and 10), acting as cams in view of the introduction of the pins. When the piece 9 is raised in pairs, simultaneously pushed by its two prolongations 13 and 14, the projection 23 towards the exterior of the band 5 is found outside its recess 22, in such a way that the button 5 is already free to be lineally displaced towards the interior of the plug-in jack base.

The button 5 has, besides the projection 23 towards the exterior, a prolongation 16 which collaborates with a cavity 17 correspondingly made in the piece 8 (see FIGS. 7, 8, 9 and 10), in order to achieve a perfect guide, and it likewise has, at its inner part, a stepping 24 positioned in such a way that it acts, during depression of the button, as an activating means of the feed breaker placed between the positive pole of the base.

Of the two terminals or female orifices, receivers of the pins of the plug-in jack, which are incorporated to the plug-in jack base of the invention, that referenced 19 (see FIG. 7) receives the feed from the network directly. The other, referenced 20, receives its corresponding pole through a breaker which is generally referenced 18 and which, according to the preferred mode of embodiment, is a rapid break switch.

As illustrated in FIG. 7, and more clearly in FIGS. 8, 9 and 10, the fixed contact 21 of the breaker is permanently connected to the orifice 20. The movable contact 26 is flexibly urged to be maintained separated from the fixed contact, when it is in the rest position, and is susceptible of being activated, through the inner stepping 24 of the button 5, to enter into contact with 21, when the button 5 is depressed.

Functioning of the plug-in jack base, object of the invention, will now be described in relation to FIGS. 8, 9 and 10, which schematically illustrate the essential basic arrangement.

FIGS. 8, 9 and 10 correspond to three different operational moments of the safety device. Specifically, FIG. 8 demonstrates the device at rest, FIG. 9 in the position which corresponds to the moment when insertion of the plug-in jack commences, with the subsequent freeing of the blocking means of the button, and FIG. 10 the connecting position, where the plug-in jack has already been inserted completely, the changeover which permits flow of current to the connecting terminals of the base, having been produced.

In FIG. 8, the piece 9 is supported on the inner portion of the button 5, by the action of its flexible positioning means 10, and the external projection 23 of said button is housed in the recess 22 with which, for such purpose, piece 9 is provided, in such a way that the inward displacement of the mentioned button cannot be effected. The inner stepping 24 of the button 5 is in contact with a portion 25 of the set of springs which produces the change in the position of the movable contact 26 of the breaker 18 and the bevelled ends, made in the form of cams, of the prolongations 13 and 14 of the already mentioned piece 9 are partially placed in front of the orifices 3' of the piece 8.

Departing from this position, and as can be seen from FIG. 9, when the pins 4 of the plug-in jack 27 start to be inserted, they push the inclined planes of the bevelled ends of the prolongations 13 and 14 of piece 9, thus forcing them to be raised, contrary to the stress of the positioning means 10, until the projection 23 of the button 5 is outside the recess 22.

The progressive penetration of the pins 4 of the plug-in jack 27 then determines that its own body is supported on the free end of the button 5, determining its inward displacement, as illustrated in FIG. 10, in such a way that its stepping 24 pushes the flexible bands 25 of the breaker 18 so that the movable contact 26 changes position and rests on the fixed contact 21, as illustrated. When this moment is reached, and as also illustrated in FIG. 10, the pins 4 of the plug-in jack 27 have been inserted in their corresponding orifices 19 and 20, thus facilitating a current outlet towards the electric apparatus or device in use.

Simultaneously with the withdrawal of the plug-in jack 27, the button is turned to its rest position by means of the flexible bands 25 themselves, which activate the breaker 18, in such a way that when pins 4 permit lowering of piece 9, the outer projection 23 of the button is already in a position to be re-housed in the recess 22, to determine a new blocking.

Logically, the type of breaker 18 represented in the drawings can be modified, without altering the essence of the invention, just as the button 5 can be provided with flexible positioning means which are independent of the flexible positioning means of the breaker itself. The nature of the invention will prevail, provided that the basic structural arrangement is the same.

According to the invention, the disconnection of the terminals of the base of the plug-in jack or, in other words, the change in the position of the movable contact 26 of the breaker 18, should be effected moments before the pins 4 of the plug-in jack 27 leave their housings. This, which is achieved by means of the embodiment, as can readily be seen from the comparison of FIGS. 9 and 10, guarantees that the base of the plug-in jack cannot become the origin of an accidental electric shock, when its terminals are accessible from the outside.

The fact that the blocking piece 9 can be freed, practically, only through the plug-in jack which is used in collaboration with the base, largely helps in the achievement of this end purpose. In effect, it should be pointed out that any other manipulation carried out on the base of the plug-in jack, by a child, for example, using any type of object which is introduced only through one of the orifices, receivers of the pins, only produce a partial raising of the blocking element 9

(refer again to FIG. 6) by means of which the outer projection 23 of the button 5 is not freed which, in this way, cannot be depressed to cause the change over which determines the current feed to the terminals.

Having described the object of the invention sufficiently, we declare that what is claimed as novel is the following:

1. An electrical outlet for receiving a pronged plug-in jack, said outlet having at least two sockets aligned to receive the jack prongs and one of said sockets being an electrically live socket, a circuit breaker associated with said live socket, said circuit breaker comprising cooperating fixed and movable contacts, a spring element coupled to said movable contact and a trigger button in engagement with said spring element and having an extremity engageable by the jack upon advancing to enter the outlet to displace said button in the longitudinal direction of said sockets to trigger said spring element and close the circuit, and a spring biassed lock engageable with said button to prevent closing of said circuit prior to insertion of said prongs into said sockets, said lock being movable between a latched position in engagement with said button to prevent displacement thereof and an unlatched position in which said button is free to be moved to close the circuit, said lock further having cam shaped portions adapted partially to cover the sockets and be displaced by the prongs upon advancing of said jack into the outlet to move said lock from said latched to said unlatched position.

2. An electrical outlet as claimed in claim 1, wherein the movable contact and spring element comprise a rapid breaking switch.

3. An electrical outlet as claimed in claim 1, wherein the spring biassed movement of the lock between the latched and unlatched positions is in a plane transverse to the direction of movement of the button, and wherein the lock is saddle-shaped and straddles the button with an arch portion engageable with said button and depending limbs having said cam shaped portions at the extremities thereof.

4. An electrical outlet as claimed in claim 3, wherein a recess in the arch portion of said lock cooperates with a projection on the button to provide a disengageable latch.

5. An electrical outlet as claimed in claim 3, wherein said saddle-shaped lock is rockable about an axis in the plane of button movement.

* * * * *